United States Patent [19]

Hayes

[11] Patent Number: 4,694,970

[45] Date of Patent: Sep. 22, 1987

[54] TAMPER EVIDENT COMPOSITE CLOSURE

[75] Inventor: Thomas H. Hayes, Lancaster, Ohio

[73] Assignee: Anchor Hocking Corporation, Lancaster, Ohio

[21] Appl. No.: 874,639

[22] Filed: Jun. 16, 1986

[51] Int. Cl.[4] ..... B65D 41/34

[52] U.S. Cl. ..... 215/252; 215/276

[58] Field of Search ..... 215/252, 276, 274

[56] References Cited

U.S. PATENT DOCUMENTS

| | | | |
|---|---|---|---|
| 3,314,564 | 4/1967 | Andersen et al. | 215/252 |
| 3,820,678 | 6/1974 | Zipper et al. | 215/274 X |
| 4,093,094 | 6/1978 | Smalley et al. | 215/276 |
| 4,473,163 | 9/1984 | Geiger | 215/276 X |
| 4,576,298 | 3/1986 | Boik | 215/252 |
| 4,595,110 | 6/1986 | Herr | 215/252 |

*Primary Examiner*—Donald F. Norton

*Attorney, Agent, or Firm*—Stoll, Wilkie, Previto & Hoffman

[57] ABSTRACT

An improved composite closure is described which includes a cover portion and a molded plastic ring portion. The plastic ring portion is molded by a new method with top tool core removal which permits formation of inwardly directed tabs or fishhooks on the tamper evident ring. The molded ring also permits the cover to be inserted from the top of the ring rather than upwardly over the ring threads, which is an easier and faster method of assembling a composite closure.

10 Claims, 7 Drawing Figures

METHOD OF FORMING COMPOSITE CLOSURE

Fig. 5.
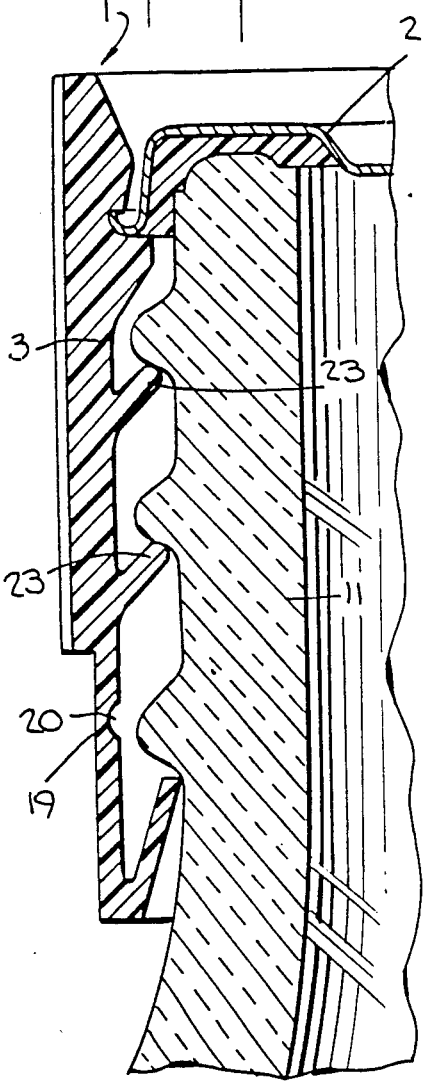
Fig. 7.
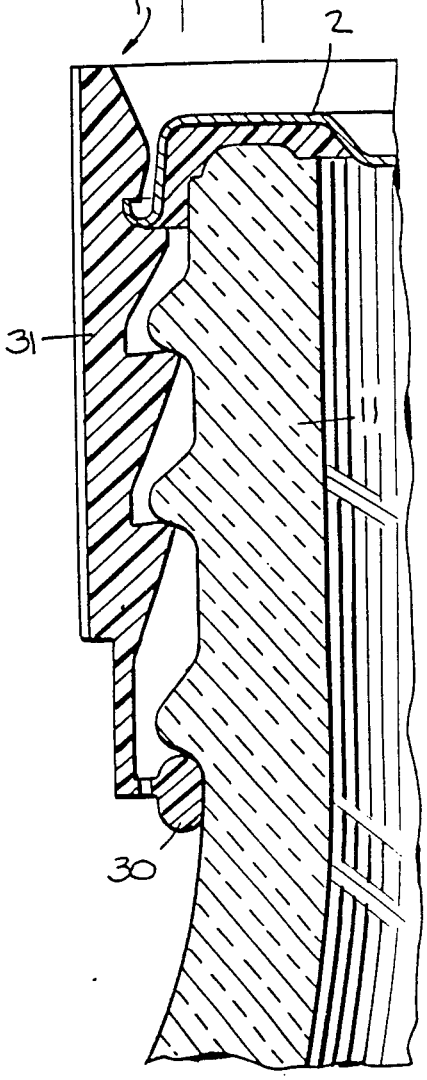
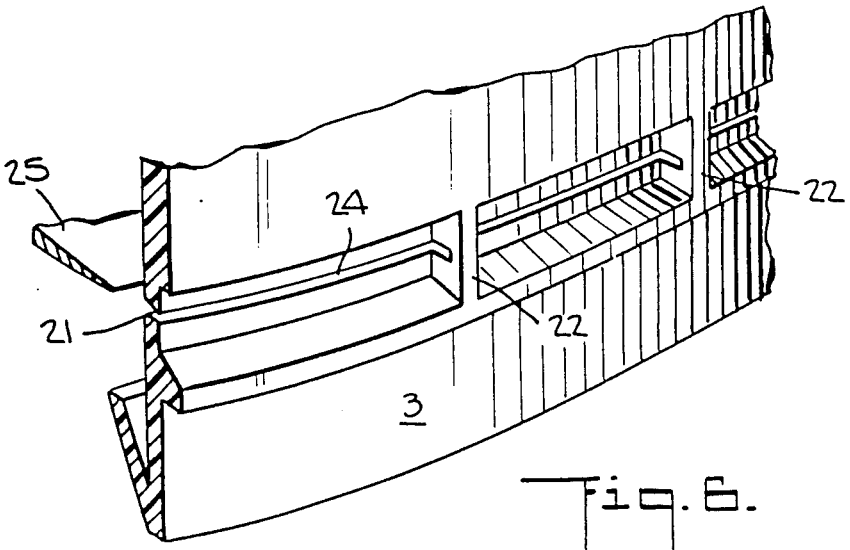
Fig. 6.

TAMPER EVIDENT COMPOSITE CLOSURE

BACKGROUND OF THE INVENTION

The present invention relates to an improved tamper evident composite closure and its method of manufacturing and more particularly to a composite closure having a molded plastic ring or skirt portion and a metal or other separate cover portion which is snapped into position at the top of the ring portion.

There are presently in use a number of composite closure caps for sealing containers which comprise a molded plastic ring or skirt portion and a metallic cover or disc which is inserted into the upper portion of the ring for completing the closure. These known closures are presently manufactured with plastic cover portions at the tops of the plastic rings for engaging an containing the separate covers. The presence of these partial covers or top flanges have caused the plastic ring to be molded so that the completed rings are stripped outwardly of the mold with the cover portion foremost. Such a molding process follows naturally from the molding or plastic closures having a full cover requiring the mold stripping to be cover first. For such molded plastic closures, with at least partial cover portions, such a molding operation is suitable and satisfactory.

More recently, however, composite closures formed of plastic rings and metal covers have added tamper indicating members at the bottoms of the molded skirts in the form of projections or locking tabs or fishhooks. Stripping such plastic rings in such a manner that the tabs or fishhooks are drawn over the remaining portions of the core has tended to destroy the tabs or fishhooks or to require them to be initially molded without any significant radially inward projection.

Accordingly, a molding method in accordance with the present invention is provided where the cover or partial cover is eliminated and the tabs or fishhooks are provided with a significant inward projection.

The composite closure cap of the present invention provides a new means for attaching separate cap covers to the tops of molded plastic ring portions and also permits a ring design with tabs or fishhooks of substantial inward depth. The molded rings in such a mold are stripped from the mold with the fishhooks being drawn outwardly from the mold without interference and with there being no significant cover portion on the molded ring to interfere with such an outward stripping movement.

Accordingly, the object of the present invention is to provide an improved composite closure cap and a method of manufacture.

Another object of the present invention is to provide an improved composite closure cap with a means for attaching a separate cover which avoids inwardly projecting full or partial plastic cover portions on the ring.

Another object of the present invention is to provide an improved tamper evident composite closure cap with premolded inwardly projecting container engaging tabs or fishhooks.

Another object of the present invention is to provide an improved method of molding the plastic ring portion of a composite closure cap.

Other and further objects of the present invention will become apparent upon an understanding of the illustrative embodiments about to be described, or will be indicated in the appended claims, and various advantages not referred to herein will occur to one skilled in the art upon employment of the invention is practice.

BRIEF DESCRIPTION OF THE DRAWINGS

A preferred embodiment of the invention has been chosen for purposes of illustration and description and is shown in the accompanying drawings, forming a part of the specification, wherein:

FIG. 5 is an enlarged detail sectional view of another embodiment of a closure cap in accordance with the present invention.

FIG. 6 is a perspective view of the plastic ring portion of a closure in accordance with the invention illustrating a line of weakness cut from the interior of the ring toward the outer surface.

FIG. 7 is an enlarged detail sectional view of another embodiment of a closure cap molded ring in accordance with the invention.

DESCRIPTION OF THE PREFERRED EMBODIMENT

Figure 1:
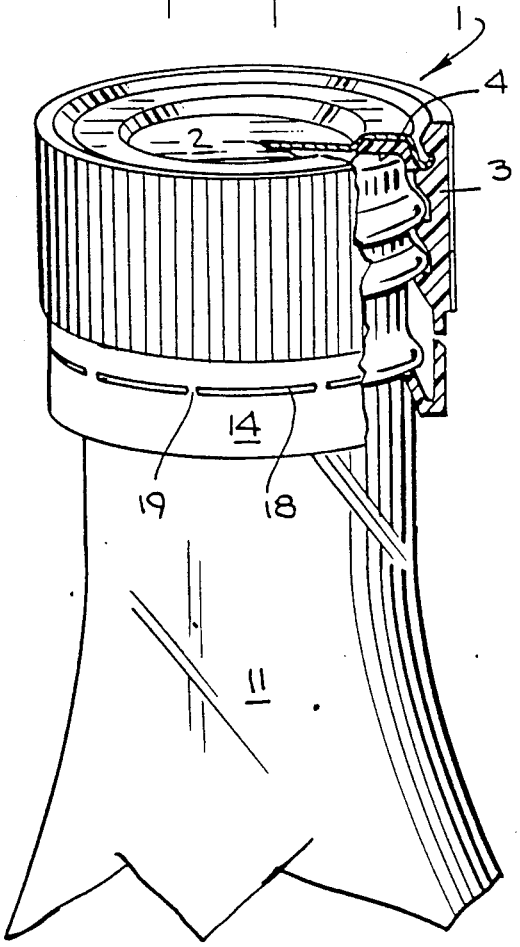
FIG. 1 is a perspective view of a composite closure in accordance with the invention.
Figure 2:
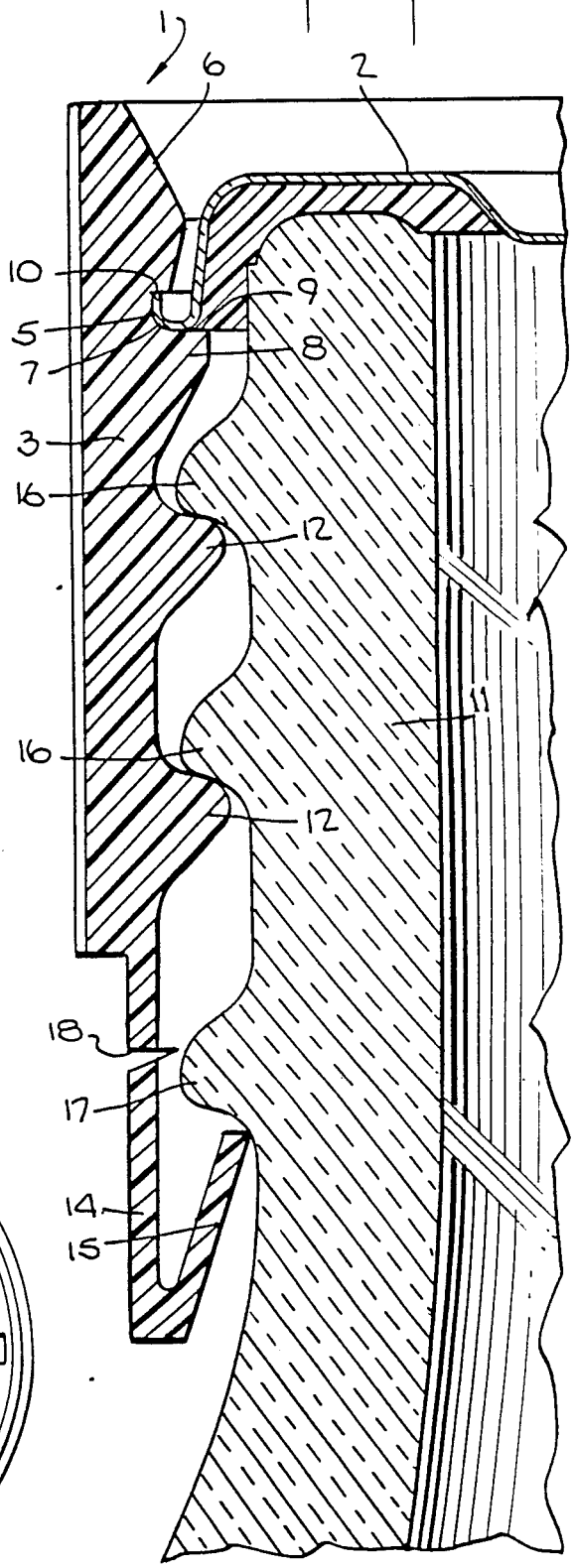
FIG. 2 is a partial vertical sectional view of the closure cap of FIG. 1.
Figure 3:
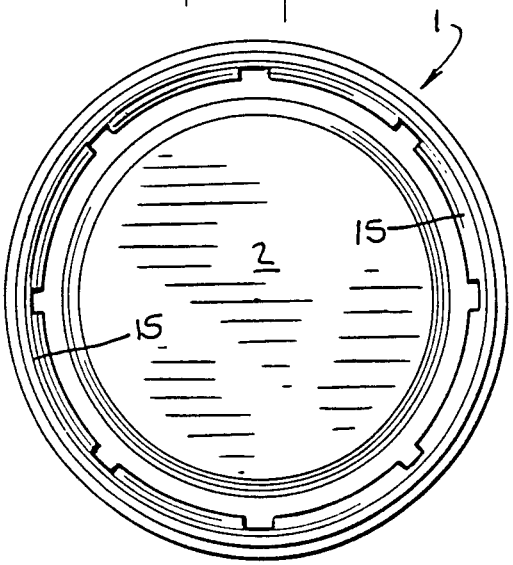
FIG. 3 is a bottom plan view of the closure cap of FIGS. 1 and 2.
Figure 4:
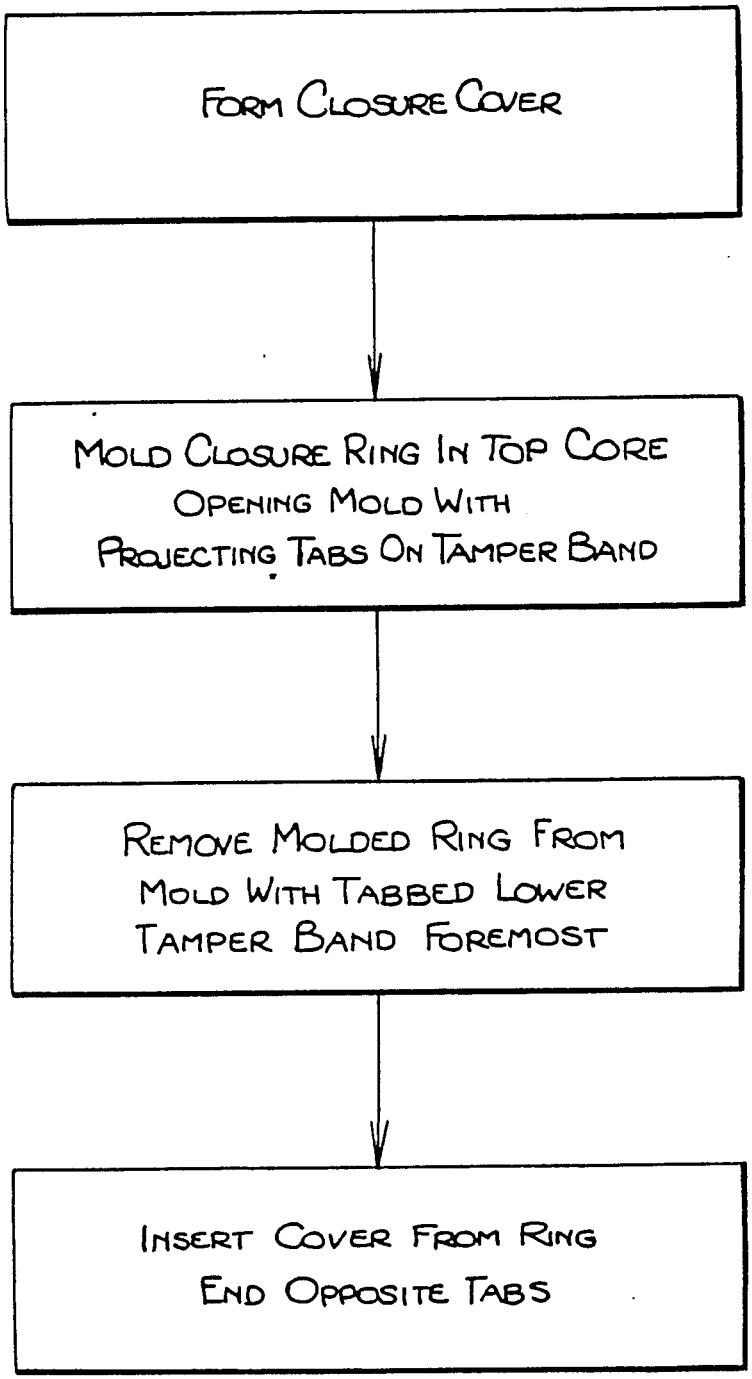
FIG. 4 is a schematic illustration for the molding sequence.

As illustrated in the figures, the closure cap for sealing container 11 comprises a composite cap 1 having a separate cover 2 and a molded ring portion 3. The cover 2 preferably comprises a blanked and stamped cover with a flowed-in or other type gasket 4. The gasket 4 may be the usual plastisol flowed-in gasket or a cut ring fastened to the rim of the cover 2.

The cover 2 is mounted on the upper portion of the plastic ring 3 in a groove 5. In the closure 1 the preferred operation for attaching the cover 2 is first by pressing it downwardly into groove 5 in the upper portion of the plastic ring 3. To facilitate this insertion operation as well as the retention of the cover 2 thereafter, the top of the ring 3 is bevelled as illustrated at 6 to facilitate the downward movement of the cover edge 7. The cover 2 is pushed downwardly until it engages a relatively narrow ledge 8 extending radially inwardly of the ring 3. Immediately above the ledge 8, the plastic ring 3 is formed to provide the groove 5 prepared to receive the cover edge 7 and having a flat lower surface 9 to receive and support the partially curled edge 7 of the cover 2 and having a relatively staight upper surface 10 to facilitate the retention of the cover 2 within the ring 3.

The curled edge 7 of the cover tool preferably is in the form of a groove gripping or fishhook shape. This causes the raw edge of the fishhook portion 7 to enter the groove 5 and to tightly engage the surface of the groove 5 thereby preventing exposure of the raw edge so that the need for an anti-corrosive coating is eliminated. The plastic ring 3 is molded with container 11 engaging threads 12 and includes a tamper evident feature in the form of a tamper evident band 14 positioned on the bottom of the ring 3.

The removal of the molding core from the top of the ring facilitates the stripping action and permits the top surface of each of the threads 12 to have a relatively horizontal upper surface whereby an improved thread retention ability results in the engagement of the thread with a relatively horizontal lower surface on the container threads 16. This upward stripping action of the mold core also facilitates the use of a slanted lower surface on each plastic ring 3 thread 12 for facilitating a press-on form of closure cap application.

The tamper evident band includes a number of inwardly directed tabs or fishhooks 15. The tabs 15 have an inwardly and upwardly extending position which permits them to snap over the container threads 16 and a tamper bead 17 when the cap 1 is applied to the container 11 and which causes the taps 15 upon cap removal to lock under the bead 17 thereby tearing the tamper band 14 free from the ring 3 of the closure 1. This ring 3 release is facilitated by a circular line of weakness 18 defining the band 14 and preferably formed by cutting an interupted groove 18 around the full circumference of the closure cap ring 3. This leaves only a number of frangible bridges 19 (FIG. 1) attaching the band 14 to the plastic closure ring before cap removal.

One preferred form of line of weakness comprises a groove 19 molded on the interior surface of the cap ring 3 as illustrated in FIG. 5. The groove weakens the skirt facilitating its rupture during cap removal. A series of bridges 20 interupt the groove on spaced locations for insuring the ring against premature rupture with a 360° cut.

Another preferred line of weakness is made by cutting through the plastic ring 3 from the inside to the outside leaving the bridges 22 between the sections of the cut 21 and leaving a stress whitened line 24 as illustrated in FIG. 6. The bridges remain partially uncut. The important advantage of this line of weakness is an action known as stress whiting which occurs as the cutter 25 penetrates the outer surface of the plastic ring 3. This whiting 24 (dash-dot) is caused by a working of the plastic causing it to have a definite whitish appearance. Where the plastic ring is colored the whiting provides a distinct indication of the tamper evident ring and of the tamper evident nature of the closure cap. The bridges 22 also remain the original color, preferably dark, to heighten the contrast. When the bridges break during cap removal they also whiten at the break to make the tamper indication more clear.

In prior tamper indicating closures of this type, tabs have been used which extend inwardly and upwardly but their final bead engaging position has resulted from a further shaping or bending operation of the fishhooks after they have been initially molded in an original position substantially coplaner with the plastic ring 3. The reason for such additional treatment of the tabs after molding in prior operations resulted from the difficulty of initially molding tabs as the prior plastic closures or plastic bands have been removed from their molds cover or top foremost. This makes it difficult to remove the tabs such as described for the present closure without weakening or destroying them as they were stripped through the dies.

It has been discovered that rings 3 shaped as described above may be molded using a top collapsing core so that the portion of the plastic molded ring first removed contains the inwardly directed tabs.

The advantage of a tab molded in accordance with the present closure results from the desirable final shaping possible and the elimination of additional shaping steps required after molding.

This significant advantage for the tamper evident closure is supplemented by the further advantage, with or without the tamper evident feature, in a simplified method of attaching the covers 2 for composite closures. The covers 2 for the present closures are inserted by being pressed directly downward and inwardly at the tops of the plastic ring. Prior assembly of composite closures, which included at least partial cover portions, required the covers 2 to be pressed from the bottom of the ring 3 past the threads 12 and any other inward projections on the plastic rings 3.

FIG. 5 illustrates another embodiment of a thread for use on the plastic rings 3 which is known as a corner thread. As illustrated at 23 in FIG. 5 these threads comprise flexible outwardly and upwardly positioned members. They facilitate cap application by flexing inwardly during cap application to pass over the container rings and threads to the sealing position. They are readily formed by the molding method of this invention as the mold core is stripped upwardly in the general direction which the threads extend outwardly and upwardly from the plastic ring.

A further improvement in the molding operation is obtained by employing what are known as wedge cores. A removal of the wedge from such cores permits the core to collapse or move radially inwardly away from substantially the entire inner surface of the molded rings. This core removal action permits the formation of sharper corners in the molded article without interfering with the mold stripping.

FIG. 7 illustrates another embodiment of a plastic ring formed in accordance with the invention. In this embodiment a shrink ring 390 is provided at the bottom of the plastic ring 31 to provide the tamper indicating band. The use of the top removed core with or without a wedge core permits the shrink ring to be positioned inwardly of remaining portions of the plastic ring 31 to minimize the amount of shrink action required during cap sealing. The above described molding method provides for easy stripping of the molded ring 31.

It will be seen that an improved composite closure has been described having a ring with a top cover mounting portion both permitting ring removal from the molds without damage to inwardly projecting tamper indicating tabs, as well as providing a more conveniently manipulated method of attaching the closure covers from the ring tops rather than by pressing the covers upwardly over the plastic ring threads and other projections.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

Having thus described my invention, I claim:

1. In a composite closure for a container having a cover fitted into a molded plastic ring and having container engaging members on the radially inner surface of said ring, the improvement comprising:

said ring comprising a relatively thin cylindrical member with a cover receiving groove positioned downwardly from the ring top and engaging the outer edge of the cover portion said container engaging members comprising continuous threads, and the outer diameter of said groove being greater than the inner diameter of said continuous threads facilitating the insertion of said cover through the top of said ring.

2. The closure as claimed in claim 1 in which said groove has a relatively flat upper surface at its cover engaging portion.

3. The closure as claimed in claim 1 in which said groove has a flat lower surface for firmly supporting said cover.

4. In a composite closure for a container having a metal cover portion fitted into a molded plastic ring portion and having container engaging members on the radially inner surface of said ring, the improvement comprising:

said ring comprising a relatively thin cylindrical member with its top having a beveled inner edge and a cover receiving groove positioned downwardly from said bevelled edge and the groove engaging the cover edge;

a tamper indicating band defined by a line of weakness and forming the bottom portion of the ring and having container engaging means extending inwardly from the lower edge of the band.

5. The closure as claimed in claim 4 in which said line of weakness comprises a cut ring with spaced bridges.

6. The closure as claimed in claim 4 in which said groove has a relatively flat upper surface at its cover engaging portion and said cover edge is raw metal.

7. The closure as claimed in claim 4 in which said groove has a flat lower surface for firmly supporting said cover.

8. The closure as claimed in claim 4 in which the container engaging members are threads with relatively flat tops.

9. The closure as claimed in claim 4 in which the container engaging members are threads with relatively steeply sloped bottom surfaces.

10. In a composite closure for a container having a cover fitted into a molded plastic ring and having container engaging members on the radially inner surface of said ring, the improvement comprising:

said ring comprising a relatively thin cylindrical member with a cover receiving groove positioned downwardly from the ring top and engaging the outer edge of the cover portion, said cover comprising a metallic disc with a curled outer edge terminating in a raw edge, and said raw edge tightly engaging the surface of the groove thereby being shielded from exposure and preventing corrosion.

* * * * *